US007561844B2

(12) United States Patent
Ishizuka

(10) Patent No.: US 7,561,844 B2
(45) Date of Patent: Jul. 14, 2009

(54) CUTTING DEVICE AND IMAGE FORMING APPARATUS

(75) Inventor: Jiro Ishizuka, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 11/530,560

(22) Filed: Sep. 11, 2006

(65) Prior Publication Data

US 2007/0059069 A1 Mar. 15, 2007

(30) Foreign Application Priority Data

Sep. 13, 2005 (JP) ..... 2005-266017

(51) Int. Cl.
*G03G 15/00* (2006.01)
*B41J 11/68* (2006.01)
*B41J 11/70* (2006.01)

(52) U.S. Cl. ..... 399/407; 83/102; 400/621; 400/621.1

(58) Field of Classification Search ..... 399/405
See application file for complete search history.

(56) References Cited

U.S. PATENT DOCUMENTS 7,261,482 B2 * 8/2007 Silverbrook et al. ..... 400/621.1

FOREIGN PATENT DOCUMENTS

| | | | |
|---|---|---|---|
| EP | 0 301 585 A2 | | 2/1989 |
| JP | 64-35452 | | 2/1989 |
| JP | 4-216580 | | 8/1992 |
| JP | 4-362679 | | 12/1992 |
| JP | 5-216322 | | 8/1993 |
| JP | 2003-84477 | | 3/2003 |
| JP | 2004-53857 | | 2/2004 |
| JP | 2005001165 A | * | 1/2005 |
| JP | 2005-169934 | | 6/2005 |
| JP | 2005-193547 | | 7/2005 |

* cited by examiner

*Primary Examiner*—Daniel J Colilla
*Assistant Examiner*—Allister Primo
(74) *Attorney, Agent, or Firm*—Fitzpatrick, Cella, Harper & Scinto

(57) ABSTRACT

A cutting device cuts and discharges a recording material on which a plurality of images is formed, and includes cutting portion and a container. The cutting portion cuts the recording material. The container contains a remaining part generated from the cut recording material and a blank sheet portion the recording material cut by the cutting portion and on which no image is formed.

10 Claims, 13 Drawing Sheets

CUTTING DEVICE AND IMAGE FORMING APPARATUS

BACKGROUND OF THE INVENTION

1. Field of the Invention

The present invention relates to a cutting device and an image forming apparatus.

2. Description of the Related Art

Conventionally, well-known image forming apparatuses include copying machines, printers, facsimiles and their multifunction peripherals, and generally use an electrophotographic technique. Not only black-and-while image forming apparatuses, but also full-color images forming apparatuses are widely commercialized.

As the image forming apparatuses are used in various fields, high quality images are demanded. Specifically, it is demanded that full-color images have a high degree of uniformity of gloss as one factor for improving the image quality.

Smoothness of an output image is one factor for determining its degree of gloss. In response to such demand, suggested is a technique for transferring a color toner including a thermoplastic resin onto a recording material having a transparent resin as a toner receiving layer made of a thermoplastic resin. Further, the color toner is heated and melts, so as to form a color image thereon (see Japanese Patent Application Laid-Open (JP-A) No. 64-35452 and JP-A No. 05-216322).

According to this image forming method, a cool-separating type of fixing device (hereinafter referred to as a belt fixing unit) having a fixing belt is preferred.

This belt fixing unit includes a fixing belt having a heat resistant film and pressuring/heating a recording material carrying an unfixed toner. In this belt fixing unit, the recording material is separated from the fixing belt after cooling the recording material while being adhered to the fixing belt so as to solidify the toner image thereon (see JP-A No. 04-216580 and JP-A No. 04-3626679).

With this belt fixing unit, the toner image is fixed in a state where it is embedded, into a transparent resin layer of the recording material. The transparent resin and toner image on the surface of the recording material are both solidified in accordance with the surface form of the belt. As a results, the recording material will have an even surface entirely, thus capable of generating a high-gloss color image.

A high-gloss image can be output by means of such a cool-separating type fixing unit. Thus, a high-gloss image of a photographic tone, such as sublimation type or silver-salt type, can be obtained using an image forming apparatus of an electrophotographic technique.

An electrophotographic transfer sheet is proposed as a recording material having a resin layer used in such an image forming apparatus. To form the transfer sheet, a resin layer is coated into a thickness of approximately 20 μm. Note this resin layer mainly has a thermoplastic resin whose glass transformation temperature is equal to for lower than 85° C. (see JP-A No. 2003-084477).

Followings are some problems in the cool-separating type belt fixing unit.

The above publications of JP-A No. 04-216580 and JP-A No. 04-362679 disclose the cool-separating type of the belt fixing unit. In this fixing unit, after a recording material is heated and pressured by a fixing portion, the fixing belt is cooled down, and the recording material is separated therefrom. After the separation, the fixing belt is heated up to a predetermined temperature before it reaches the fixing portion again, and is heated up and pressured again by the fixing portion.

While the fixing belt goes around the above temperature cycle from the heating until the cooling, the fixing belt should be kept long enough to reach the fixing temperature and the separation temperature. As a result, the conveying speed decreases, thereby decreasing the output number in a unit time.

To enhance the output number, the fixing belt may possibly be conveyed at a higher speed. However, in such a case, a great amount of power is required for heating and cooling. Therefore, this method could not easily be realized.

According to a proposal, when a small size of sheet is used in image forming requiring a high-gloss photographic image, many images are formed on a sheet of a larger size, and output images are cut into a predetermined size using a separated cutter. The small size of sheet may, for example, be an L-size (127 mm×89 mm), KG size (152 mm×102 mm), or post-card size (148 mm×100 mm).

Specifically, proposed is a printing system having a post-processor which cuts a resultant object on which an image has been formed by a continuous (serial) paper printer (see JP-A No. 2004-053857). With such a printing system, four images of the above L size, KG size and post-card size can be output using only an A4 size sheet for each case. If the sheet on which images of a plurality of sheets are formed is cut into a predetermined size by a cutting unit, thereby obtaining output images of the predetermined size.

However, according to the above system, while the images are formed by the body machine, the sheet is cut by a different device. Thus, the user needs to cut the sheet on which the pluralities of images are arranged, giving the user some extra work to do.

When the user-desired number of output images differs from the actual number of generated sheets after being cut, a problem is that an unnecessary output object is included in the output sheets. For example, when three images of L size are output using a recording material of A4 size, the three images are arranged in the respective our divisions of the material so as to be output. The recording material of A4 size is cut into, four pieces, thus generating one blank sheet. In such a case, the user needs to dispose this blank sheet, i.e. user needs to do some extra work.

SUMMARY OF THE INVENTION

It is accordingly an object of this invention to provide a cutting device, which can free the user from extra work and can increase the output number of images within a unit time, and an images forming apparatus including the cutting device.

To achieve above-mentioned object, the present invention provides a cutting device which cuts a recording material on which a plurality of images are formed, said device comprising:

a cutting portion which cuts the recording material; and a container which contains a remaining part generated from the cut recording material; wherein said container contains a blank sheet of the recording material having no image formed thereon after being cut by said cutting portion.

An image forming apparatus of the present invention comprising:

an image forming unit which forms an image on a recording material;

a cutting portion which cuts the recording material on which a plurality of images are formed, according to image;

a container which contains a remaining part generated from the cut recording material; wherein said container contains a blank sheet of the recording material having no image formed thereon after being cut by said cutting portion.

A cutting device of the present invention which cuts a recording material on which a plurality of images is respectively formed at a plurality of image arranging position, said device comprising:

a cutting portion which Cuts the recording material so that a plurality of recording material respectively having the image arranging position are formed, wherein said cutting portion cut: a recording material so that a remaining part are formed by cutting between an edge of the recording material and the image arranging position; and a container which contains said remaining part, wherein a recording material, after being cut by said cutting portion, on which no image is formed at its image arranging position is contained in said container.

BRIEF DESCRIPTION OF THE DRAWINGS

The invention, together with further advantages thereof, may best be understood by reference to the following description taken in conjunction with the accompanying drawings in which.

DESCRIPTION OF THE EMBODIMENTS

Preferred embodiment of the present invention will now specifically be described with reference to the drawings. In the entire drawings of the preferred embodiments, the same or corresponding components are identified with the same symbols. This invention can preferably be applied to a color image forming apparatus that can form a plurality of images on a single recording material.

First Embodiment

Figure 1:
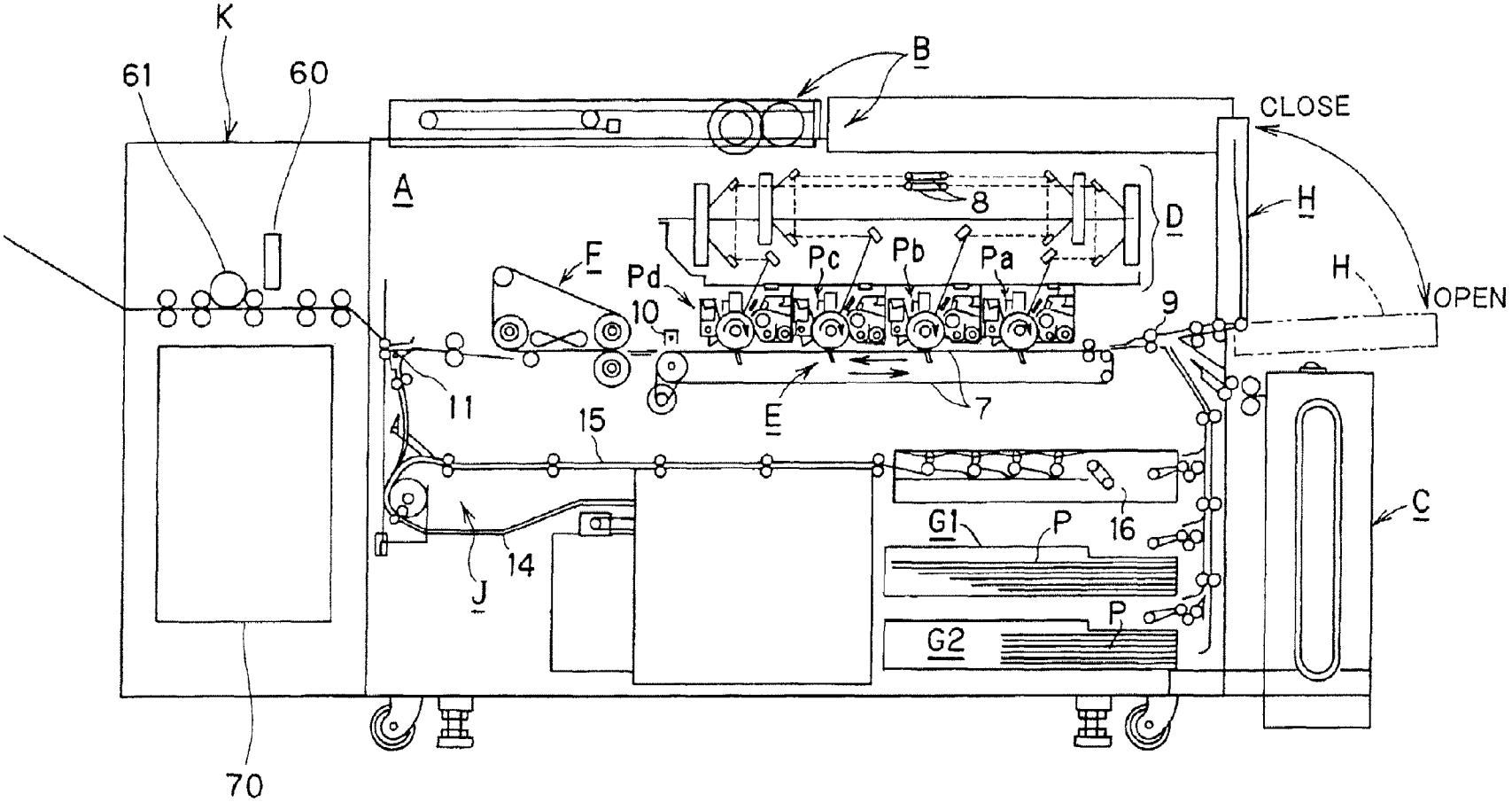
FIG. 1 is an exemplary diagram showing th structure of an image forming apparatus in which a fixing device is mounted and included in a first embodiment.

A first embodiment of this invention will now be described with reference to the drawings. FIG. 1 shows an image forming apparatus that can preferably be connected to a cutting device according to this invention.

Image Forming Apparatus

The image forming apparatus according to the first embodiment of this invention is a full color laser beam printer of four colors, using an electrophotographic process. This image forming apparatus comprises a printer body A, a reader mechanism B provided on the top surface side of the printer body A and a large capacity sheet feeder C provided on the right side surface in the view of the printer body A.

The printer body A includes a first image forming portion Pa, a second image forming portion Pb, a third image forming portion Pc and a fourth image forming portion Pd, sequentially in a horizontal direction from the upper right to upper left of FIG. 1. That is, the laser beam printer according to the first embodiment is a tandem type (in-line) image forming apparatus.

A laser scanning mechanism D (a laser scanner D) has a plurality of optical scanning means provided above the first to fourth image forming portions Pa, Pb, Pc and Pd. A transfer belt mechanism E is provided below the first to fourth image forming portions Pa, Pb, Pc and Pd. A fixing device F provided on the downstream side along the conveying direction of the recording material with respect to the transfer belt mechanism E. A first sheet cassette G1 and a second sheet cassette G2 are provided in two vertical stages below the transfer belt mechanism E.

A manual sheet tray H is provided on the right side surface of the printer body A in the view of FIG. 1. This manual sheet tray H can be shut and stored onto the printer body A as shown with a solid line in the illustration. When the manual sheet tray H is used, the tray is in such an open state as shown with two dot lines in the illustration.

The reader mechanism B can perform a color separation reading process for full color copy of image information, using a photoelectric transducer (a solid state imaging device (CCD)) or the like. The laser scanning mechanism D outputs laser beams modulated in accordance with the read image information regarding each color separation sent from the reader mechanism B, respectively to the first to fourth image forming portions Pa, Pb, Pc and Pd.

Figure 2:
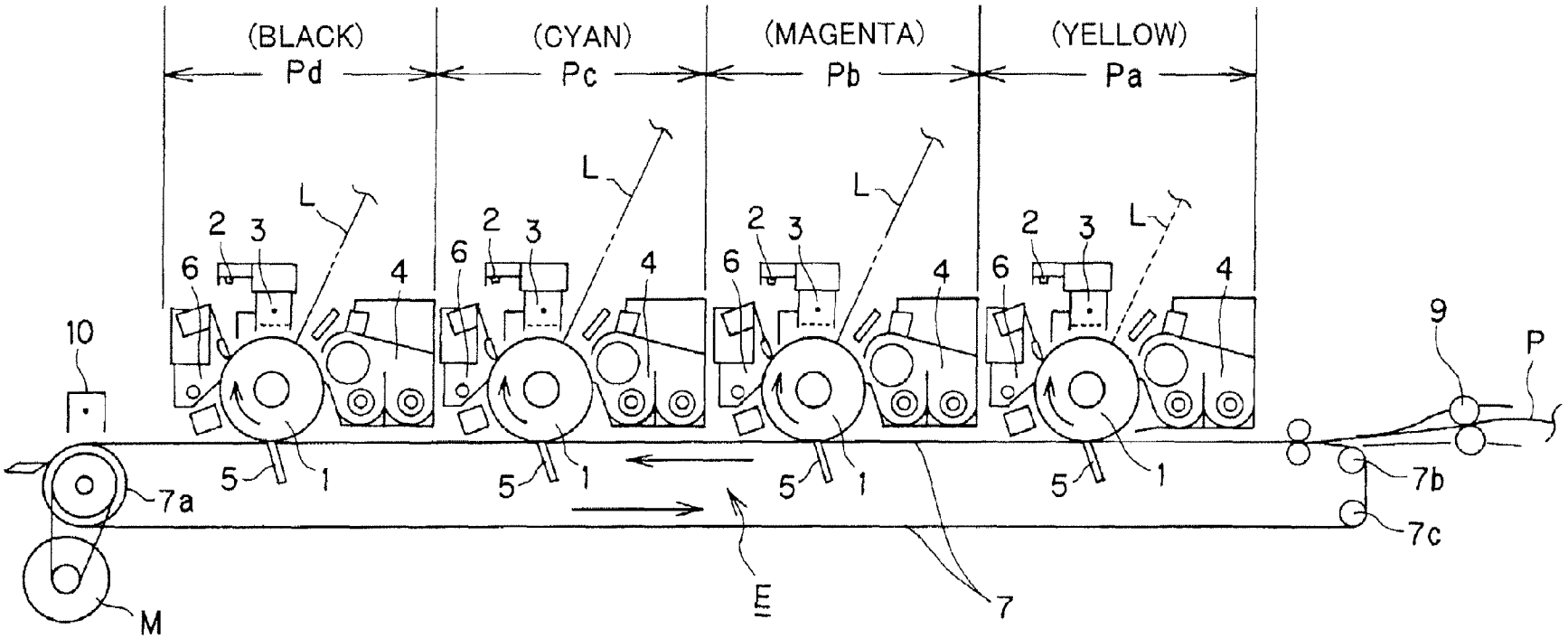
FIG. 2 is an enlarged view showing a first to fourth image forming portions and a transfer belt in the image forming apparatus according to the first embodiment of this invention.

FIG. 2 shows the first to fourth image forming portions Pa, Pb, Pc and Pd and the transfer belt mechanism E. The first to fourth image forming portions Pa, Pb, Pc and Pd have the same structure. That is, each of the first to fourth image forming portions Pa, Pb, PC and Pd has an electrophotographic photosensitive member drum (photosensitive drum 1) as an image bearing member. Each of the first to fourth image forming portions Pa, Pb, Pc and Pd comprises an entire surface exposure lamp 2 (charge removing lamp), a primary charge 3, development unit 4, a transfer charger 5 and a cleaner 6, as processing means acting on this photosensitive drum 1.

The development unit 4 of each of the first to fourth image forming portions Pa, Pb, Pc and Pd is filled with a predetermined amount of toners of yellow, magenta, cyan and black, by a feeder.

The transfer belt mechanism E includes an endless transfer belt 7, a driving roller 7*a* and turn rollers 7*b* and 7*c* all hanging around the belt 7 in tension. The driving roller 7*a* is rotatively driven through a power transmission, such as a timing belt unit, etc. by a driving motor M. As a result, the transfer belt 7 is rotatively driven at a predetermined speed in a reverse, clockwise direction as indicated by the arrow. The transfer belt 7 is made from a dielectric resin sheet. The dielectric resin sheet may be a polyethylene terephthalate (PET) resin sheet, a polyvinylidene fluoride resin sheet, a polyurethane resin sheet, etc. One example of this dielectric resin sheet is a seamless belt whose end parts are put together so as to be connected in an endless form.

Description will now be made to a process for forming a fill color image. The first to fourth image forming portions Pa, Pb, Pc and Pd are successively driven at a timing corresponding to forming an image. In response to this driving operation, the photosensitive drums 1 rotate in an arrow direction (in a clockwise direction) shown in FIG. 2. Similarly, the transfer belt 7 of the transfer belt mechanism B is also rotatively driven, and the laser scanning mechanism D is driven as well. In synchronization with this driving operation, the surface of the photosensitive drum 1 is electrified evenly to have a predetermined polarity and potential thereon by the primary charger 3.

As shown in FIG. 1, the laser scanning mechanism D performs scanning exposure of a laser beam on the surface of each of the photosensitive drums 1 in accordance with an image singal. As a result, an electrostatic latent image is formed on the surface of the photosensitive drums 1 in accordance with of image signal. That is, the laser scanning mechanism D rotates a rotary polygon mirror 8 to allow a laser beam emitted from a light source to perform scanning. The flux of scanning beams is polarized by a refection mirror, collected on a bus of the photosensitive drums 1 by an fθ lens for exposure. As a result, an electrostatic latent image is formed on the photosensitive drums in accordance with the image signal. Thus formed electrostatic latent image is developed as a toner image by the development unit 4.

As a result of the processing operation for forming an electrophotographic image, a yellow toner image of a full color image is formed or the peripheral surface of the photosensitive drum 1 of the first image forming portion Pa. A magenta toner image of a full color image is formed on the peripheral surface of the photosensitive drum 1 of the second image forming portion Pb. A cyan toner image of a full color image is formed on the peripheral surface of the photosensitive drum 1 of the third image forming portion Pc. A black toner image of a full color image is formed on the peripheral surface of the photosensitive drum 1 of the fourth image forming portion Pd.

A sheet feeding roller of one feeding unit is driven. This feeding unit is one selected from the large capacity sheet feeder C, the first sheet cassette G1, the second sheet cassette G2 and the manual sheet tray H. As a result of the driving roller, a sheet of the recording material P contained in the selected feeding unit is separated therefrom and fed. Then, the fed sheet is supplied onto the transfer belt 7 of the transfer belt mechanism E through a plurality of conveyance rollers and a registration roller 9, The recording material P supplied onto the transfer belt 7 is conveyed sequentially to transfer units of the respective first to fourth image forming portions Pa, Pb, Pc and Pd.

That is, if it is identified that the transfer belt 7 of the transfer belt mechanism E is in a predetermined position upon rotational driving by the driving roller 7*a*, the recording material P is transmitted from the registration roller 9 to the transfer belt 7, and conveyed to the transfer unit of the first image forming portion Pa. At the same time, an image write signal is turned on.

When this image write signal is turned on, an image is formed on the photosensitive drum 1 of the first image forming portion Pa at a predetermined timing. If an electric field or charge is given from the transfer charger 4 to the transfer unit below the photosensitive drum 1, the yellow toner image of the first color formed on the photosensitive drum 1 is transferred on he recording material P. Upon this transfer, the recording material P is firmly kept by electrostatic absorption force on the transfer belt 7.

Subsequently, the recording material P is sequentially conveyed to the transfer units of the second to fourth image forming portions Pb, Pc and Pd. The recording material P accepts toner images of magenta, cyan and black that are formed on the respective photosensitive drums 1 of the image forming portions. In this case, such toner images are superposed one upon another and transferred on the recording material P. As a result, toner images of four full colors are synthesized on the recording material P.

The charges are removed by a separation electrifier 10 from the recording material P having the toner images of four full colors synthesized thereon, on the downstream side along the conveying direction of the transfer belt 7. As a result, the electrostatic absorption force of the recording material P is attenuated, resulting in that the recording material P gets away from the end part of the transfer belt 7. In particular, the recording material P dries in a low moisture environment, resulting in an increase in the electrical resistance and also an increase in the electrostatic absorption force with respect to the transfer belt 7. Hence, the charge removing process by the separation electrifier 10 is very effective. Because the separation electrifier 10 usually removes charges from the recording material P in a state where a toner image is unfixed, a non-contact charger is used.

The recording material P coming off from the transfer belt 7 is conveyed to the fixing device F. The recording material P is heated and pressured by this fixing device F, and color mixture of the respective colors of toner images is performed. Thereafter, a fixing process is conducted for this recording material P, thus generating a full-color-image formed object.

When a single-side image formation mode is selected, a recording material P discharged from the fixing device F passes above a selector 11 maintained in a first position, and is discharged onto an external discharge tray I from a discharge port 13 by a discharge roller 12.

When a both-side image formation mode is selected, the recording material P discharged from the fixing device F is directed to the side of a reversal re-feeding mechanism J by the selector 11 switched into a second position. Note, to this case, the fixing process has a ready been performed for a first side of the recording material P. In a reversal unit 14 (switchback mechanism) of this reversal re-feeding mechanism J, the material P is turned over and conveyed to a sheet re-feeding path 15, and then contained once in an intermediate tray 16.

The recording material contained in the intermediate tray 16 is transmitted to the registration roller 9 from the intermediate tray 16 by a sheet feeding roller driven at a predetermined controlled timing. This recording material P is fed again from the registration roller 9 onto the transfer belt 7 of the transfer belt mechanism E in a state where the second side of the material P is turned upward. Just like the case of image formation for the first side of the material P, toner images of four full colors are synthesized on the second side, using the first to fourth image forming portions Pa, Pb, Pc and Pd.

The recording material P, second side of which has the toner images formed thereon, comes off from the transfer belt 7 and is conveyed to the fixing device F. In this fixing device F, the toner images are fixed on the second side of the recording material P. After this, the material P passes above the selector 11 switched into the first position, and discharged onto the external discharge tray I from the discharge port 13 by the discharge roller 12, as a both-side mace formed object.

A monochrome image formed object or a single color image formed object may be output as the image formed object. In such a case, if its corresponding image formation mode is selected, of the first to fourth image forming portions Pa, Pb, Pc and Pd, only an image forming portion corresponding to the selected image formation mode executes an image forming operation. In the rest of image forming portions, the photosensitive drums are rotatively driven, but the image forming operation is not conducted. The transfer unit of the image forming portion executing the image forming operation performs the sequence for transferring toner images on the recording material conveyed by the transfer belt mechanism E.

Fixing Device F

Figure 3:
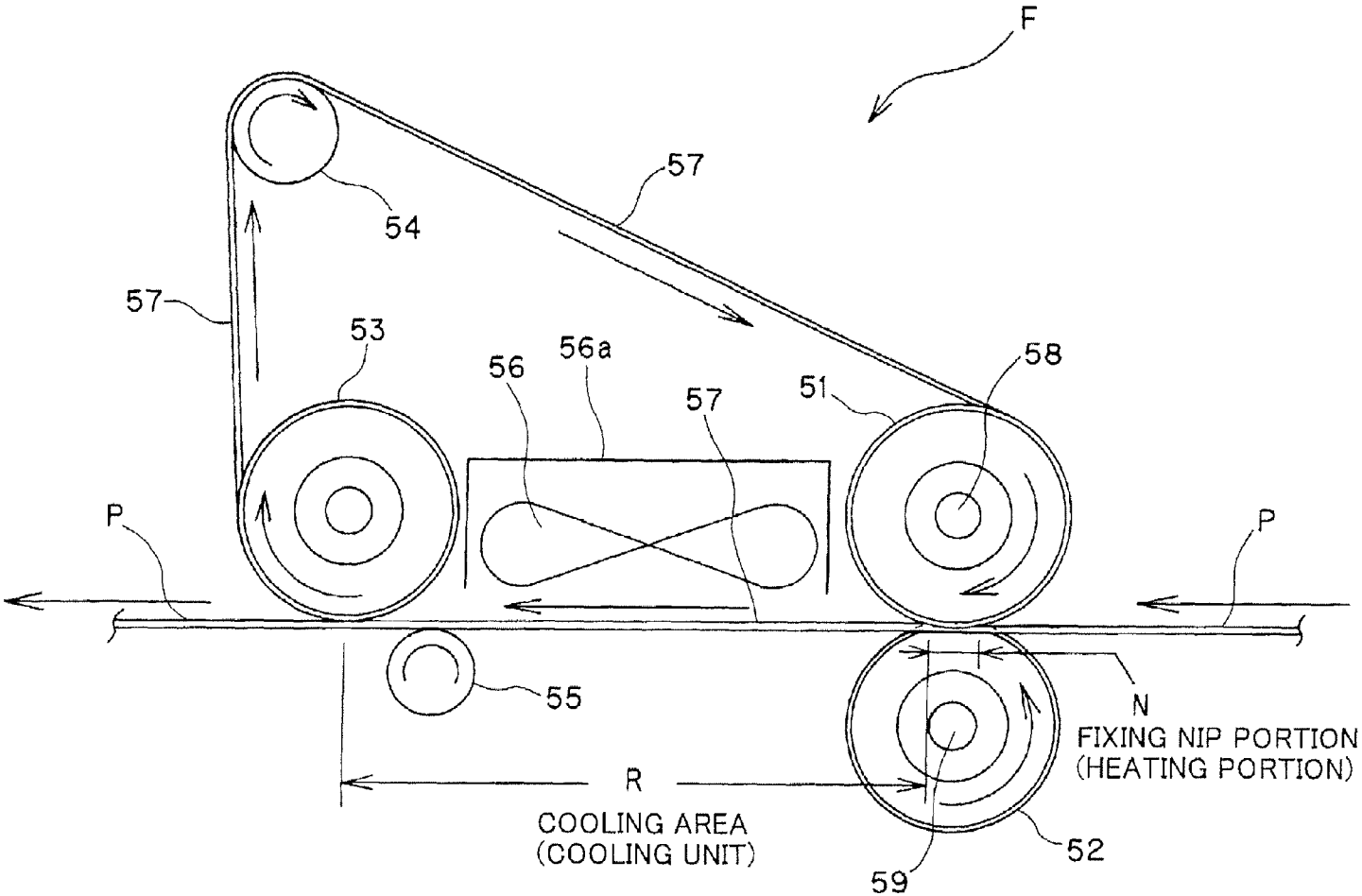
FIG. 3 is an enlarged view of the fixing device according to the first embodiment of this embodiment.

FIG. 3 shows an enlarged view of the fixing device F according to the first embodiment. The fixing device F in this embodiment is, for example, a belt fixing unit.

As shown in FIG. 3, the belt fixing unit F comprises a first fixing roller 51, a separation roller 53 and a tension roller 54. The separation roller 53 is set up with a predetermined space from the first fixing roller 51 (hereinafter referred to as a fixing roller 51). The tension roller 54 is set up above the separation roller 53.

Theses three rollers (the fixing roller 51, the separation roller 53 and the tension roller 54) are hung around an endless (having no ends) fixing belt 57 in tension. A second fixing roller 52 (hereinafter referred to as a pressure roller 52) as a pressure roller is set opposite to and in press contact with the fixing roller 51 across the fixing belt 57.

An auxiliary roller 55 is in contact with the external surface of the fixing belt 57 in a position near the separation roller 53, in a position between the fixing roller 51 and the separation roller 53 on the fixing belt 57.

A cooling fan 56, which performs air-cooling for the fixing belt part between the fixing roller 51 and the separation roller 53, is provided between the fixing roller 51 and the separation roller 53 inside the fixing belt 57. The above-described fixing roller 51, the pressure roller 52, the separation roller 53, the tension roller 54 and the auxiliary roller 55 are arranged substantially in parallel with each other.

Note that the fixing roller 51 has a concentric three-layered structure. This three-layered structure includes the core part, an elastic layer and a mold release layer sequentially from the center of the roller. The core part includes an aluminum-made hollow pipe having a diameter of 44 mm and a thickness of 5 mm. The elastic layer is made from silicone rubber having a JIS-A strength of 50 degrees and a thickness of 300 μm. The mold release layer is made from PFA having a thickness of 50 μm. A halogen lamp 58 as a source of heat (roller heater) is provided inside the hollow pipe corresponding to the core part.

The pressure roller 52 has almost the same structure as that of the fixing roller 51, except that the elastic layer is made from silicone rubber having a thickness of 3 mm in order to form a fixing nip by the elastic layer. A halogen lamp 59 as a source of heat (roller heater) is provided inside the hollows pipe corresponding to the core part.

The fixing roller 51 and the pressure roller 52 form a fixing nip portion N as a healing portion and pressure portion having a predetermined width in a conveying direction of the recording material, and are in press contact with each other with a predetermined pressure force across the fixing belt 57. Note that the pressure force of the pressure roller 52 is set to 490N (50 kgf), in total. At this time, the fixing nip portion N has a width of 5 mm.

The surface strength of the fixing roller 51 is selected in accordance with the fixing belt 57. If the surface of the fixing roller 51 is soft, the fixing belt 57 is bent, the toner can not sufficiently be inserted into the receiving layer of the recording material, thus resulting in a level difference in the toner. If the strength of the fixing belt 57 is low (soft), in order to increase the strength of the fixing roller 51 (make it hard), the elastic layer is made thin, or only the PFA is formed on its surface without the elastic layer if necessary, or only the aluminum core is prepared.

A single layer belt of siloxane modified polyimide is used for the fixing belt 57 in this first embodiment, as will be explained later. Note that the surface of the belt (the surface that the recording material P is in contact with) is made in a specular form.

The fixing roller 51 is rotatively driven at a predetermined speed in an arrow direction (clockwise) as shown in FIG. 2 by a driving mechanism (not illustrated), Upon rotational driving of this fixing roller 51, the fixing belt 57 rotates in an arrow direction (clockwise direction in FIG. 3). The separation roller 53, the tension roller 54, the pressure roller 52 and the auxiliary roller 55 rotates in accordance with the rotation of the fixing belt 57. A predetermined level of force is given to the fixing belt 57 by the tension roller 54.

If electric power is supplied to the halogen lamps 58 and 59 that are provided respectively in the fixing rollers 51 and the pressure roller 52, the halogen lamps 58 and 59 generate heat, and the insides of the respective fixing roller 51 and pressure roller 52 are heated, thus increasing the surface temperature. The surface temperatures of the fixing roller 51 and pressure roller 52 are detected by respective thermistors (note illustrated).

The temperatures detected by the thermistors are fed back to a controlling circuit (not illustrated). The controlling circuit controls the electric power to be supplied to the halogen lamps 58 and 59 such that the detected temperatures input by the thermistors can be maintained at a predetermined temperature set for each of the fixing roller 51 and the pressure roller 52. That is, the fixing roller 51 and pressure roller 52 are controlled at predetermined temperatures, and the temperature of the fixing nip portion N is controlled at a predetermined fixing temperature.

The recording material P, on whose surface an unfixed toner image is formed, is transmitted from the side of the transfer belt mechanism E to the side of the belt fixing unit F. Then, the material P is introduced between the fixing belt 57 corresponding to the fixing nip portion N and the pressure roller 52, and is held by and conveyed through the fixing nip portion N.

The surface of the recording material P. on which an unfixed toner image is formed, faces the surface of the fixing belt 57. The recording material P is heated and pressured while being held by and conveyed through the fixing nip portion N. and color toner images are mixed and fixed on the recording material P. At the same time, the recording material P is adhered closely to the surface of the fixing belt 57.

Then, while being adhered closely to the fixing belt 57, the recording material P rotates in accordance with rotation of the fixing belt 57, and is conveyed through a cooling area (cooling unit) between the fixing nip portion N and the separation roller 53. In this cooling area R, the recording material P is forced to be cooled down efficiently by an effect of the cooling fan 56 and airflow occurring inside an air duct 56*a* enclosing the fan 56. Airflow perpendicular to the paper surface is generated by the cooling fan 56.

In this manner, the recording material P while being adhered to the surface of the fixing belt 57 is sufficiently cooled down in the cooling area R. The recording material P reaches the position of the separation roller 53, and comes off (curvature separating) by means of its own stiffness from the surface of the fixing belt 57 in an area that the curvature of the fixing belt 57 changes by means of the separation roller 53.

Due to the auxiliary roller 55, the recording material P is prevented from coming off from the surface of the fixing belt 57 in the middle of the cooling area R of the fixing belt 57 in the range from the fixing roller 51 to the separation roller 53. In addition, disturbance of image is prevented, and the material P keeps being conveyed in the range.

To output a gloss-image formed object, a recording material having a toner-receiving layer (image receiving layer, glossing layer) top-coated with a resin is used as a recording material P. In this case, the temperature of the receiving layer increases, resulting in that the layer will become soft, due to the heat of the fixing nip portion N while the recording material P is held by and conveyed through the fixing nip portion N. The toner is embedded in the high-temperature receiving layer of the recording material P, since the pressure of the fixing nip portion N is applied thereto. At the same time, the recording material is adhered to the surface of the fixing belt 57.

After that, the recording material P is forced to be cooled down sufficiently and efficiently, while being conveyed through the cooling area R in accordance with the rotation of the fixing belt 57, in a state where the recording material P is adhered to the fixing belt 57. The recording material P to be cooled down is curvature-separated from the surface of the fixing belt 57 in the range that the curvature of the fixing belt 57 changes by the separation roller 53.

Figure 4A:
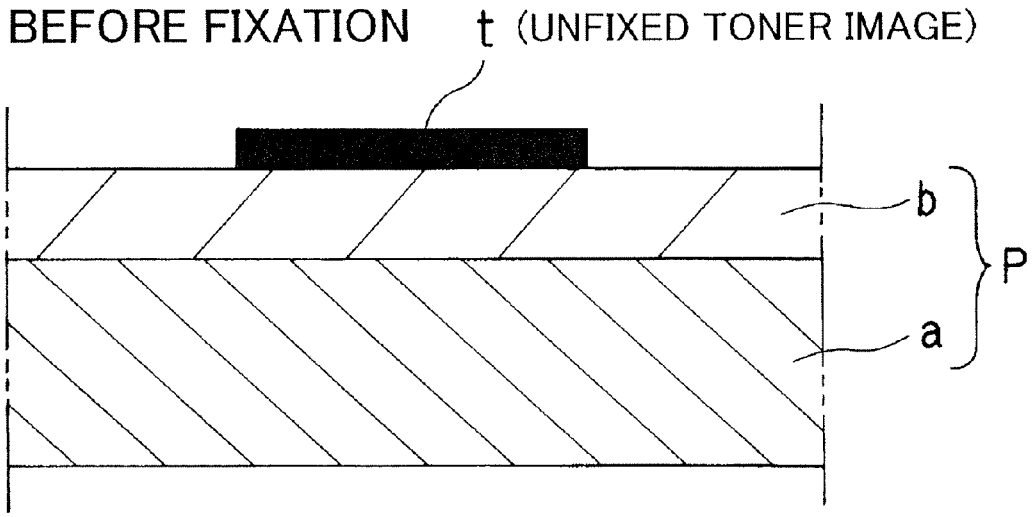
FIG. 4A is an exemplary diagram of a recording material before fixation in which an unfixed toner image remains on its receiving layer.
Figure 4B:
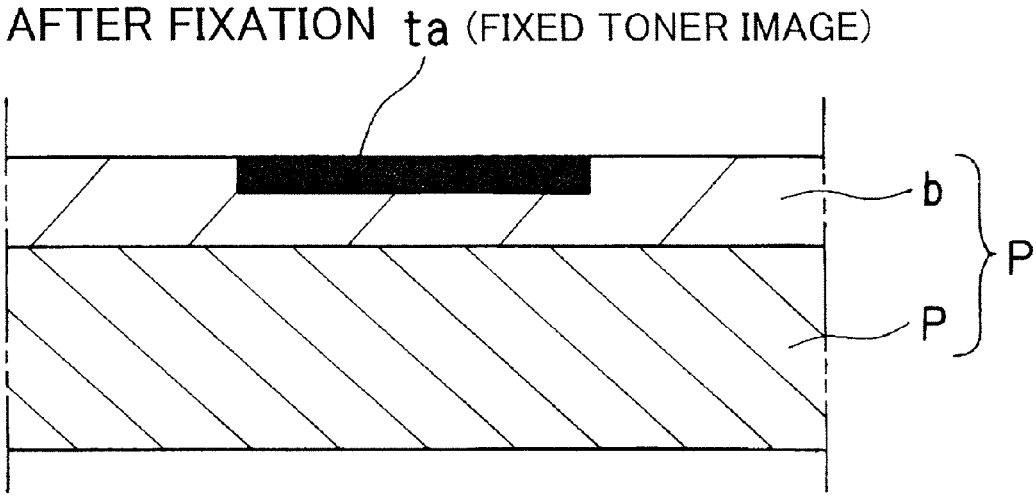
FIG. 4B is an exemplary diagram of a recording material after fixation in which a toner image is embedded in the receiving layer.

FIG. 4A shows a recording material in an unfixed state where an unfixed toner image t is put on a receiving layer b of the recording material P. FIG. 4B shows a recording material in a fixed state where a toner image is embedded in the receiving layer. The receiving layer b and fixed toner image ta on the surface of the recording material, wherein the toner image is embedded and fixed in the receiving layer b, are both fixed in accordance with the specular form of the belt surface, in addition, the recording material has a smooth surface in its entirety, thus generating a high-gloss image.

The recording material P used in this invention will now specifically be described.

The outstanding feature of a coated sheet is that a toner-receiving layer of its uppermost lager melts at a temperature near the fixing temperature. Due to this feature, a toner image is embedded in the toner-receiving layer when fixing the toner image onto the recording material, thus reducing a level difference in the toner as described above.

Specifically, a transparent resin layer is added to the above-described coated sheet having a pigment coating layer, thus forming the recording material P. In this formation, the recording material P has a pigment layer in the lower layer and a highly white smooth surface. Therefore, there is no need to mix a pigment into the resin layer of the uppermost layer, and a system for increasing the whiteness is not necessary. Thus, the transparent resin layer having a thermoplastic surface can be designed to have a high degree of gloss and to have a system, for embedding a toner image therein, before everything else. Another advantage is that a new coated sheet is not necessarily formed.

Such a recording material may be a known POD super gloss coated sheet manufactured by Oji Paper Co., Ltd. According to one specific example of manufacturing the recording material, a coated sheet including the above-described pigment coating layer is formed on a base material as a base sheet. One side or both sides of the base sheet is/are coated with a thermoplastic resin using a gravure coater, thereby forming a predetermined coated sheet.

A resin for forming the transparent resin layer may be a polyester resin, a styrene-acrylic acid ester resin, a styrene-methacrylate acid ester resin, etc. In particular, the polyester resin is preferable. Followings are some examples of a polyhydric alcohol component and a polycarboxylic acid component for forming the polyester resin.

Examples of a polyhydric alcohol component are: ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, and a monomer including an olefin oxide added to bisphenol A.

Examples of a polycarboxylic acid component are: maleic acid, maleic anhydride, fumaric acid, phthalic acid, terephthalitc acid, isophthalic acid, malonic acid, succinic acid, glutaric acid, dodecyl succinic acid, n-octyl succinic acid, n-dodecyl succinic acid, 1,2,4-benzenetricarboxylic acid, 1,2,4-cyclohexane tricarboxylic acid, 1,2,4-naphthalene tricarboxylic acid, 1,2,5-hexanetricarboxylic acid, 1,3-dicarboxy-2-methyl-2-methylenecarboxypropane, tetra (methylenecarboxy) methane, 1,2,7,8-octanetetracarboxylic acid, trimellitic acid, pyromellitic acid and their lower alkylester.

A polyester resin forming the transparent resin layer is composed as a result of polymerization of one or more than one of the above polyhydric alcohol components and one or more than one of the above polycarboxylic acid components. A polyester resin is mainly used for color toners as a resin component for toners, while a styrene-acrylic resin is mainly used for a monochrome toner. As a result, it is preferred that a thermoplastic resin for forming a transparent resin layer should have high compatibility with a corresponding toner. Thus, in accordance with its purpose, one or more than one kind of compound may be selected from a polyester resin, a styrene-acrylic acid ester resin and a styrene-methacrylate acid ester resin.

Further, the transparent resin layer may include a pigment, a mold release agent, a conductive agent or the like within an extent that its clarity is kept. In this case, it is preferred that the amount of resin as the primary constituent part be 80 percentage by weight or more for the entire weight of the resin layer. Further, the transparent resin layer preferably has such a controlled composition that the electric resistance of the surface is $8.0\times10^{8}\Omega$ or greater at a temperature of 20° C. and 85% relative humidity. As long as the coated sheet has a molten characteristic that its surface melts at a temperature near the fixing temperature and includes a thermoplastic resin layer, the coated sheet is not restricted to having the multi-layered structure, and can include various additives, such as a pigment and the like. The method for forming the coated sheet is not necessarily limited to the above.

Description will now be made to a molten characteristic (near the fixing temperature) of the resin having the toner-receiving layer. That is, the molten characteristic can be quantified by measuring viscoelasticity, using plastics-resins in the liquid state or as emulsion or dispersions-determination of viscosity using a rotational viscometer with defined shear rate (JIS K 7117-2).

This measurement is conducted for the surface of the coated sheet having a resin whose surface layer melts at a temperature near the fixing temperature. The preferable storage elastic modulus is equal to or lower than $1\times10^7$ Pa·s at a temperature of 150° C., and more preferable storage elastic modulus is equal to or lower than $1\times10^6$ Pa·s at a temperature of 150° C.

However, if the coated sheet has the multi-layered structure on its surface, the viscoelasticity cannot in many cases be measured. That is, the uppermost layer is coated with a resin whose storage elastic modulus is $1\times10^7$ Pa·s at a temperature of 150° C. into a thickness from 1 to 5 μm. Further, the lower layer is coated with a resin whose storage elastic modulus is $1\times10^3$ Pa·s at a temperature of 150° C. into a thickness from 10 to 50 μm. Even in this case, the gloss degree is changed, and the toner can be embedded therein.

Because a plurality of layers have an efficient function as a whole, it is difficult to show a combination of the storage elastic modulus of a single resin or the storage elastic modulus of a resin composed of a plurality of resins, in consideration of an effect of the changed gloss or an effect of the embedded toner. For measuring the viscoelasticity, it is very difficult to collect such an amount of resin of the upper most layer used in an ordinary coated sheet.

In the first embodiment, description will now be made to a method for distinguishing between an ordinary coated sheet whose surface layer does not melt and a coated sheet having a resin layer whose surface layer melts at a temperature near the fixing temperature.

The coated sheet is inserted into the fixing device, kept in the fixing nip for five seconds so as to be heated sufficiently enough, and then removed therefrom. At this time, the state of the surface of the recording material is checked, i e. the state as to whether the resin has melted, thereby distinguishing the kind of the coated sheet.

In more particular, upon this measurement, the resin of the surface melts in the coated sheet having the resin which melts at a fixing temperature, and then the coated sheet is pushed out from the fixing nip. As a result, the trace of the fixing nip remains as a level difference on the coated sheet. The molten characteristic of the coated sheet can be determined in accordance with whether there is the level difference. The resin gets out on the upstream side along the forward direction, rises on the upstream side, and gets thinner in the nip. Further, after melting on the downstream side of the nip, the resin gets smashed on the downstream side after passage of the nip. After all these processes, the level difference will become a little smooth. This level difference has a thickness in a range from 1 to 10 μm, though still depending on the thickness of the resin layer.

On the contrary, there is almost no level difference in the coated sheet including a pigment coating layer which does not melt at a temperature near the fixing temperature. This kind of coated sheet has a smooth irregular surface, because it has been pressured in the nip, and may be discolored due to the applied heat.

After an unfixed toner image is formed on the above-described recording material, and heat fixing is performed using the fixing device, the recording material is cooled down and is separated from the fixing belt, thereby obtaining a high-gloss image of a photographic tone.

Recording Material Cutting Device

Figure 5:
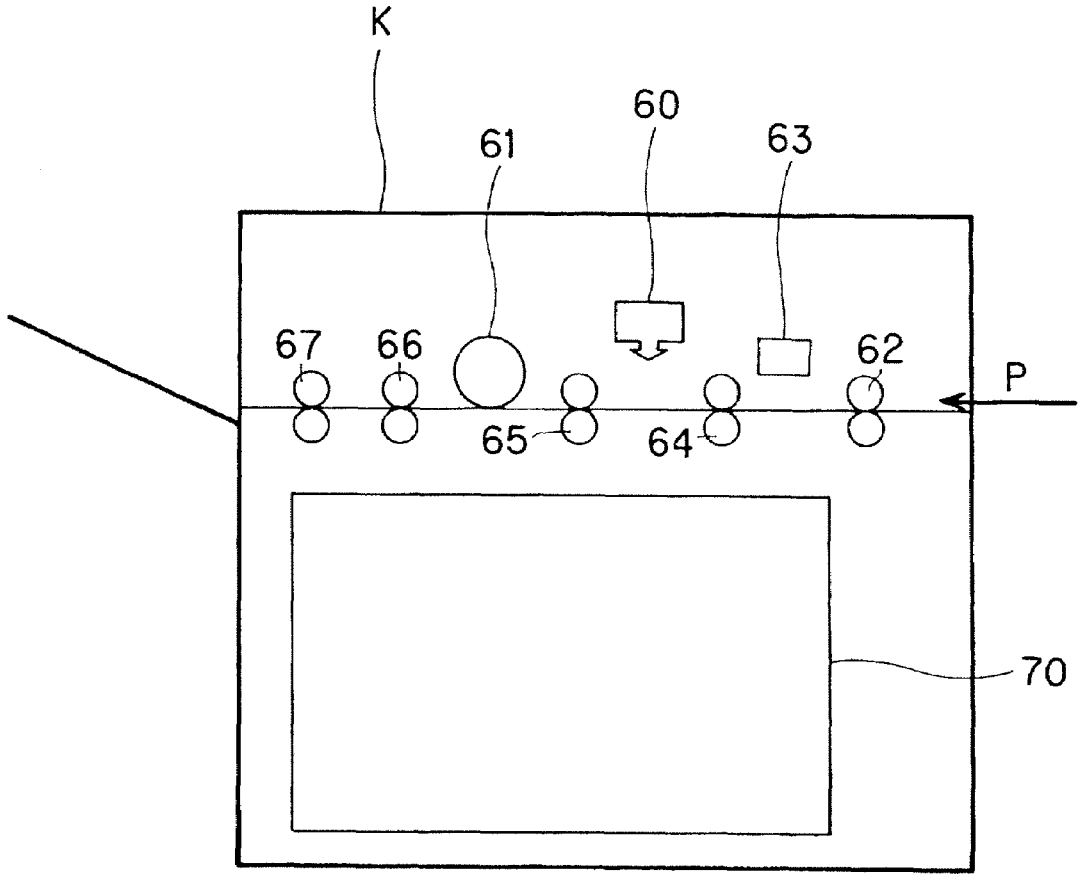
FIG. 5 is a schematic diagram of a recording material cutting device according to the first embodiment of this invention.

Description will now be made to a recording material cutting device as the cutting device according to the first embodiment of this invention. FIG. 5 shows a recording material cutting device K.

As shown in FIG. 5, the recording material cutting device K cuts a recording material in a predetermined size, using a guillotine cutter 60 and a rotary cutter 61. The guillotine cutter 60 cuts the recording material P in a direction perpendicular to the conveying direction. The rotary cutter 61 cuts the recording material P along the conveying direction.

That is, an out-put recording material P fixed by the fixing device F is conveyed into the recording material cutting device K shown in FIG. 5. The recording material P conveyed into the recording material cutting device K is first conveyed to a registration detecting sensor 63 preceding the cutter, by a conveyance roller 62. The position of the recording material P is detected by the registration detecting sensor 63. The guillotine cutter 60 begins operating in accordance with detection information regarding the position of the recording material P.

The guillotine cutter 60 is arranged in such a way that the longitudinal direction of its tooth longer than the maximum paper passing width is perpendicular to the conveying direction of the recording material. If this tooth falls from the top to the bottom of the recording material P, thereby successfully cutting the recording material P in a direction perpendicular to its conveying direction. The conveying process per se is carried out by conveyance rollers 64, 65, 66 and 67.

Image Processing Method

Figure 6:
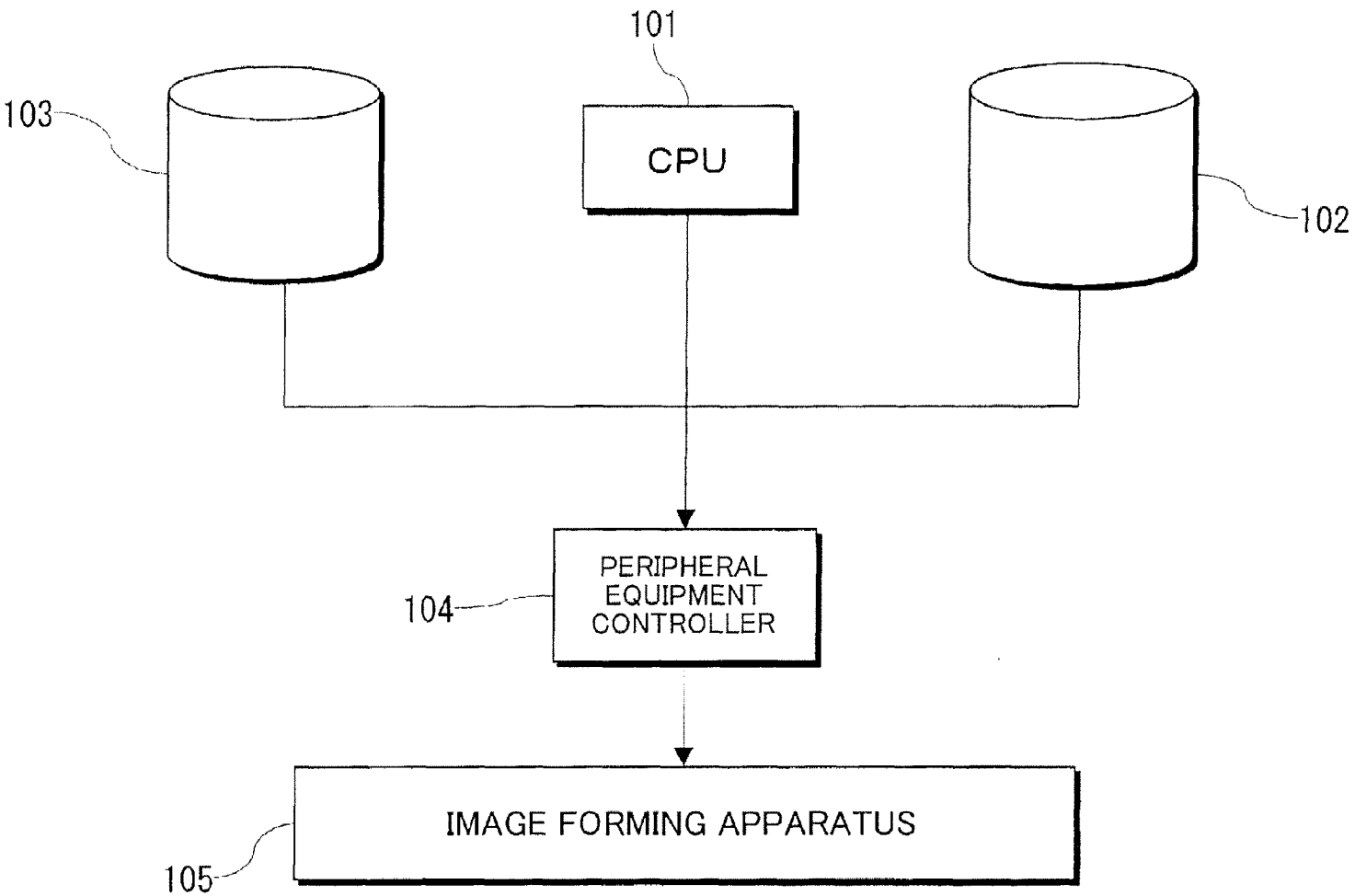
FIG. 6 is a block diagram schematically showing an image forming processor of the image forming apparatus according to the first embodiment of this invention.

Description will now be made to an image processing method according to the first embodiment. FIG. 6 shows a block diagram of a system for executing an image processing method for forming a plurality of images on a single recording sheet.

As shown in FIG. 6, the system for executing the image process comprises a Central Processing Unit (CPU) 101, an internal storage device 102 (typically a random access memory (RAM) directly connected to the CPU, an external storage device 103 (typically a hard disk), a peripheral equipment controller 104 (typically Centronics, SCSI, USB, etc.) and an image forming apparatus 105.

In thus formed system, an operator (user) operates an image forming processor (not illustrated), such as a computer or the like. Information regarding images to be output is supplied to the CPU 101 as image formation information together with the number of output copies.

Subsequently, the CPU 101 successively executes image arrangement determination program codes of the internal storage device 102. As a result, a method for arranging image data stored in the external storage device 103 on a single sheet is determined, thereafter generating output positional information regarding images.

The CPU 101 generates a final version of output in formation based on the generated output position information and the image data. The CPU loads the output image data in the form of a bit string on the internal storage device 102 based on the output information. The output image data is transferred to the image forming apparatus 105 through the peripheral equipment controller 104. The image forming apparatus 105 outputs an image representing the arrangement of the plurality of images on a single sheet in accordance with given output information.

Figure 7:
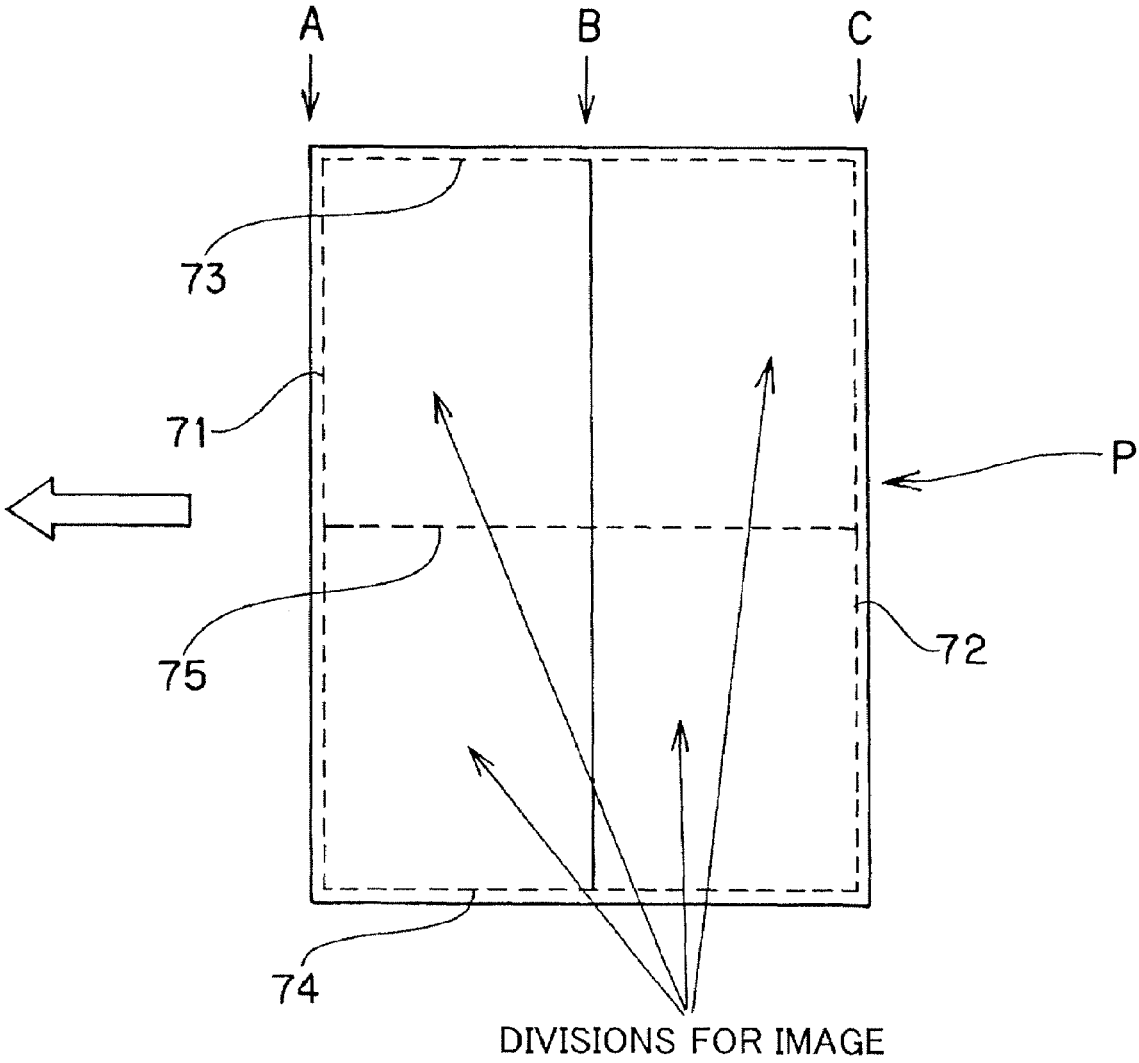
FIG. 7 is a diagram of a recording material that is cut by the cutting device according to the first embodiment of this invention.

FIG. 7 shows the arrangement of the images. As shown in FIG. 7, the recording material P of A4 wide size (320 mm×216 mm) includes images of KG (152 mm×102 mm) size in the respective four divisions of the material.

Recording Material Cutting Device

Description will now be made to the case where a sheet is inserted into the recording material cutting device K. As shown in FIG. 5, when a head position A of the recording material P is detected by the registration detecting sensor 63, the guillotine cutter 60 moves upward, and is suspended until complete conveyance of the recording material P. When the head position A passes the conveyance roller 64 and an image leading edge line 71 reaches right underneath the guillotine cutter 60, the conveyance roller 64 stops, and the conveyance of the recording material P stops as well.

In response to the stoppage of the recording material P and the conveyance roller 64, a cutter motor (not illustrated) operates. As a result, the guillotine cutter 60 falls to cut the image leading edge line 71 of the recording material P in a direction nearly perpendicular to the conveyance direction. Then, the guillotine cutter 60 is lifted up again, and stops in a predetermined position.

The conveyance roller 64 operates again. In response to this operation, the recording material P is conveyed again, an the head position of the recording material P is transmitted to the conveyance roller 65. The remaining part (a scrap) is freely falls downward in the cutting device, and collected into a trash 70 as a container shown in FIG. 5.

Subsequently, the recording material P is conveyed. When an intermediate position B reaches right underneath the guillotine cutter 60, the conveyance rollers 64 and 65 stop, and the conveyance of the recording material P stops as well. At this time, the cutter motor operates again, and the guillotine cutter 60 falls down. The intermediate position B of the recording material P is cut in a direction perpendicular to the conveyance direction. The guillotine cutter 60 is lifted up again, and stops in a predetermined position of the upper part.

The conveyance rollers 64 and 65 operate again, and the recording materials P1 and P2 are conveyed again. The recording material P1 is conveyed to the rotary cutter 61 by the conveyance roller 65. The recording material P2 is conveyed again by the conveyance rollers 64 and 65. When an image trailing edge line 72 reaches right underneath the guillotine cutter 60, the recording material P stops being conveyed, and the guillotine cutter 60 moves upward and downward so as to cut at the trailing end portion, as described above. In this situation the remaining part is formed. The remaining part (a scrap) is freely falls downward in the cutting device, and collected into a trash 70 as a container shown in FIG. 5.

Figure 8:
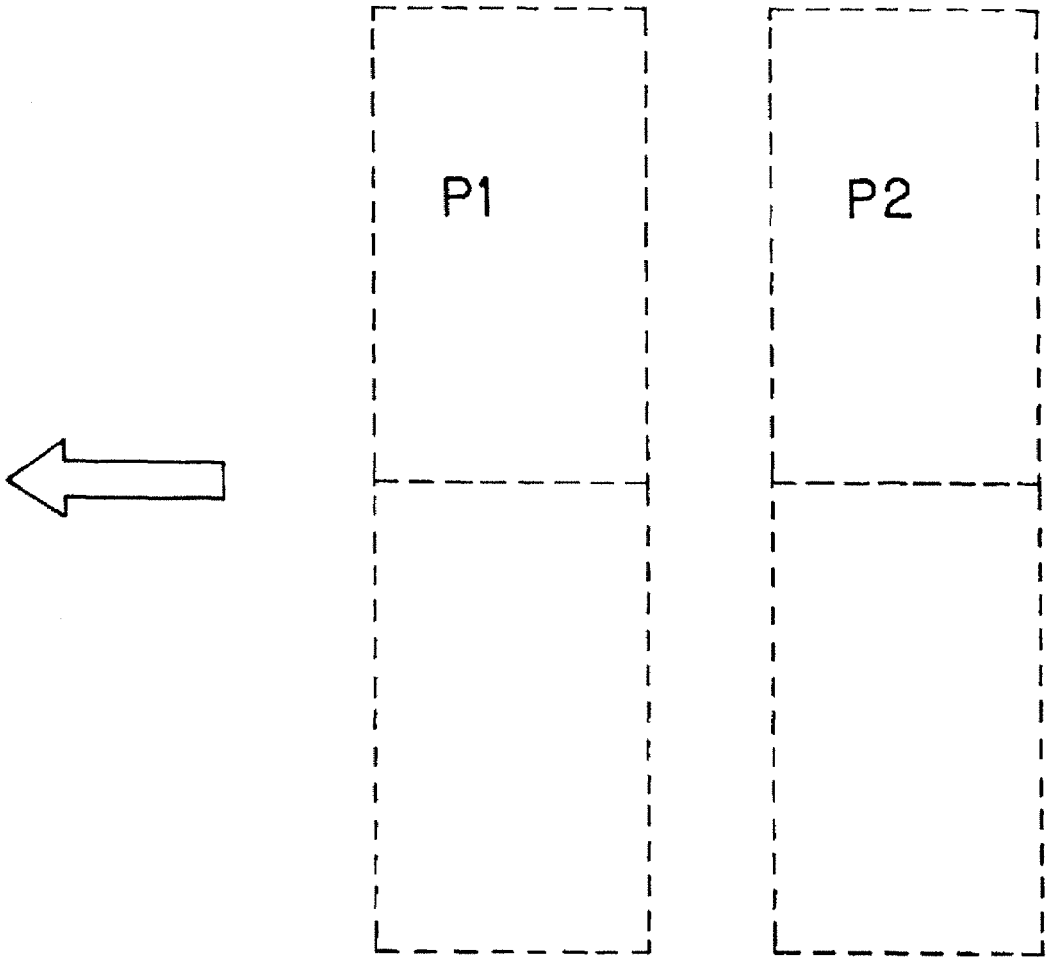
FIG. 8 is an exemplary diagram of a recording material that is cut by the cutting device according the first embodiment of this invention.

As a result of a series of the above operations of the guillotine cutter 60, the recording material P is cut along the conveyance direction into two parts P1 and P2: i.e. P1 in a range from the an image leading edge line 71 to the intermediate position B; and P2 in a range from the intermediate position B to the image trailing edge line 72, as shown in FIG. 8.

The rotary cutter 61 will now specifically be described. The rotary cutter 61 includes a disk-like teeth part. The disk-like teeth part includes a plurality of teeth each of which is parallel to the conveying direction of the recording material P and arrangement of which is perpendicular to the conveying direction of the recording material P.

While rotation of the plurality of teeth, the recording material P is conveyed into the teeth part. Upon this, the recording material P can automatically be cut along the conveying direction. The rotary cutter 61 cut recording material P cut image far side edge line 73, image near side edge line 74 and central line 75. Remaining parts are formed when the rotary cutter 61 cut recording material at the image far side edge line 73 and the image near side edge line 74. The remaining parts (scraps) freely falls downward in the cutting device, and are collected into a trash 70, as a container shown in FIG. 5. If the above-described recording material P1 is conveyed to the rotating rotary cutter 61 by the conveyance roller 65, the recording material P1 is cut automatically along the conveying direction. If the position of the rotary cutter 61 is set in accordance with a predetermined sheet size, the recording material can be cut in various sizes.

In particular, in the case of the above-described KG size, two cutters are provided respectively on the far and near sides, and two cutters are provided in the center. According to this arrangement, the recording material P1 can be cut into two recording materials P3 and P4 lining up in a direction perpendicular to the conveying direction.

Thus formed recording materials P3 and P4 are discharged outside the device by the conveyance rollers 66 and 67. Subsequently, the recording material P2 formed by the guillotine cutter 60 is conveyed to the position of the rotary cutter 61, and cut into two recording materials P5 and P6 in the same manner as described above. The recording materials P5 and P6 are discharged outside the device.

As explained above, the recording material cutting device cuts a recording material on which a plurality of images are respectively formed at a plurality of an image arranging position.

The teeth part of the rotary cutter 61 is moved in a direction perpendicular to the conveying direction of the recording material, either manually or automatically, thereby capable of cutting the recording material P in various sizes. Further, if the teeth part of the rotary cutter 61 is lifted up likewise the guillotine cutter 60, the recording material P is prevented from being cut down.

Figure 9:
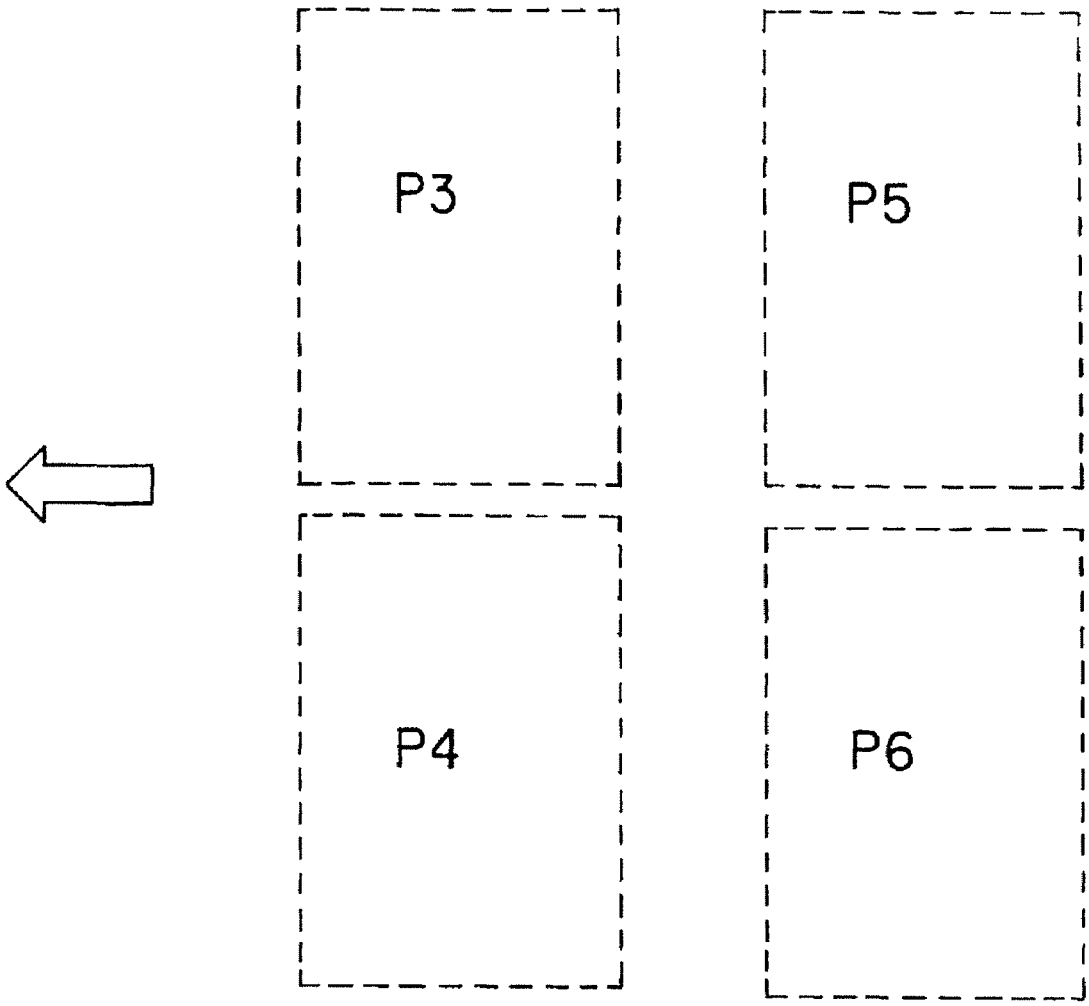
FIG. 9 is a exemplary diagram of a recording material that is cut by the cutting device according to the first embodiment of this invention.

As described above, the recording material P of A4 wide size can be output in the form of four recording materials P3, P4 P5 and P6 of KG size, as shown in FIG. 9. According to this method, four recording materials of the KG size can be output only within the same time period for forming a single recording material P of A4 size, for example. Thus, the number of output copies per unit time can be increased.

Figure 10:
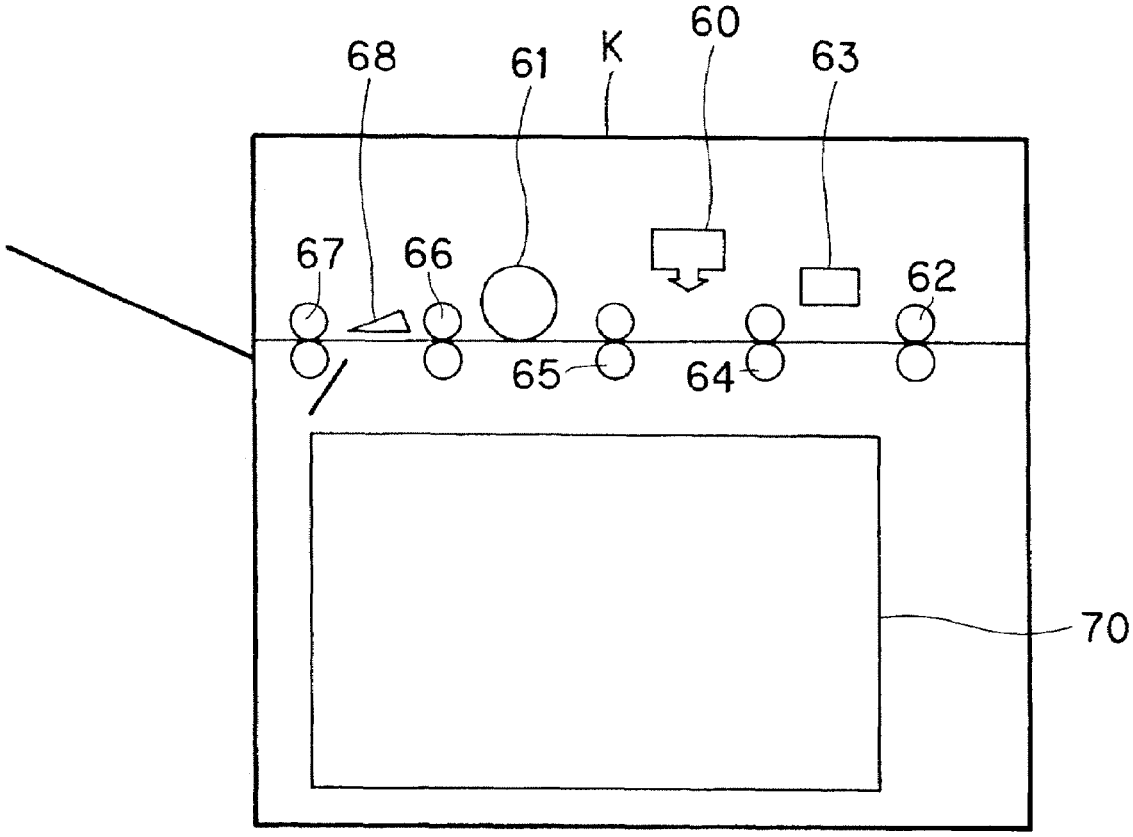
FIG. 10 is a schematic line diagram showing a flapper used in the cutting device according to the first embodiment of this invention.

However, in the above case, for example, a cut blank material (a blank sheet) is formed, when no image is formed on the recording material P6. The recording material cutting device K cuts the recording material so that a plurality of recording material respectively having the image arranging position is formed. A recording material, which has been cut by the recording material cutting device K, on which no image is formed at its image arranging position is a blank sheet. In this first embodiment a plurality of flappers 68 are provided between the conveyance rollers 66 and 67 in a direction perpendicular to the conveying direction of the recording material P, as shown in FIG. 10. In FIG. 10, only one flapper 68 is shown, however, another flapper 68 is actually provided on the far side. According to this structures a recording material including no output image on it is collected into the trash 70, of the individual recording materials P3 to P6.

Figure 11:
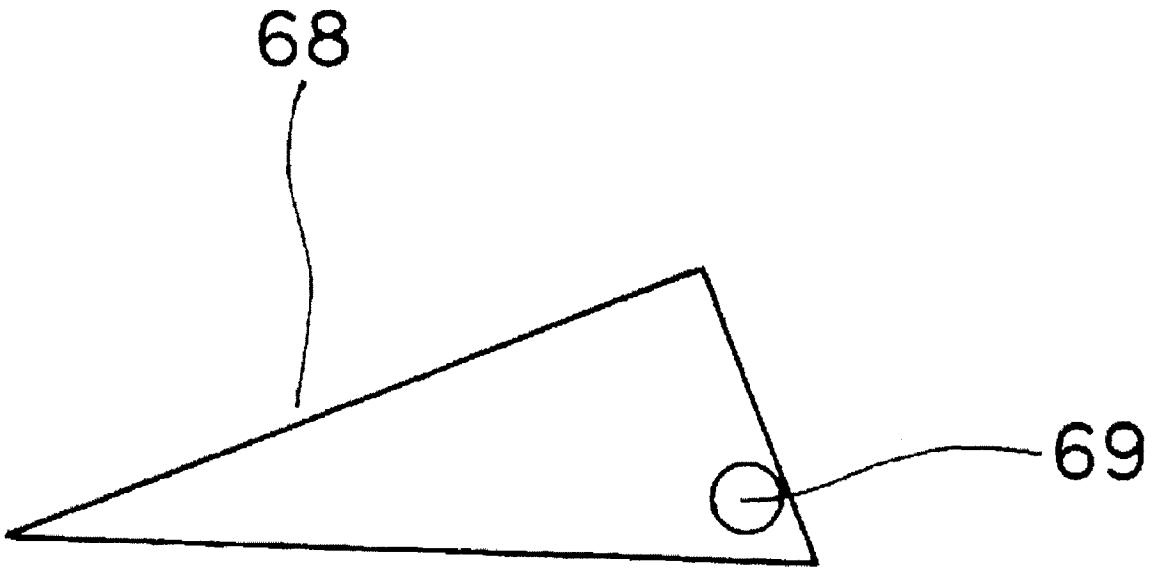
FIG. 11 is a diagram showing the arrangement of the flapper when outputting an image-formed recording material according to the first embodiment of this invention.

The flappers 68 are made of a resin or metal. As shown in FIG. 11, each of the flappers 68 is formed in a vertically movable shape on its axis 69. Note that the CPU 101 as a controller can determine whether an image is formed, based on an amount of image information.

That is, the CPU 101 determines whether there is a blank sheet in the output materials based on the total number of images to be output within one job and the number of images arranged on a single recording materials (in this case, the number of images is "4"). When a plurality of images are arranged on the recording material before being cut, which part of the recording material will be left blank can be set in advance. For example, when four images can be arranged on a single recording material, one blank sheet may be generated from the cut pieces of the recording material. In such a case, the lower right portion of the recording material in FIG. 7 can be set in advance as a blank sheet. If two blank sheets will be generated, the lower and upper right portions in FIG. 7 are set in advance as blank sheets. If three blank sheets will be generated, the lower and upper right portions and the lower left portion in FIG. 7 are set in advance as blank sheets.

Figure 12:
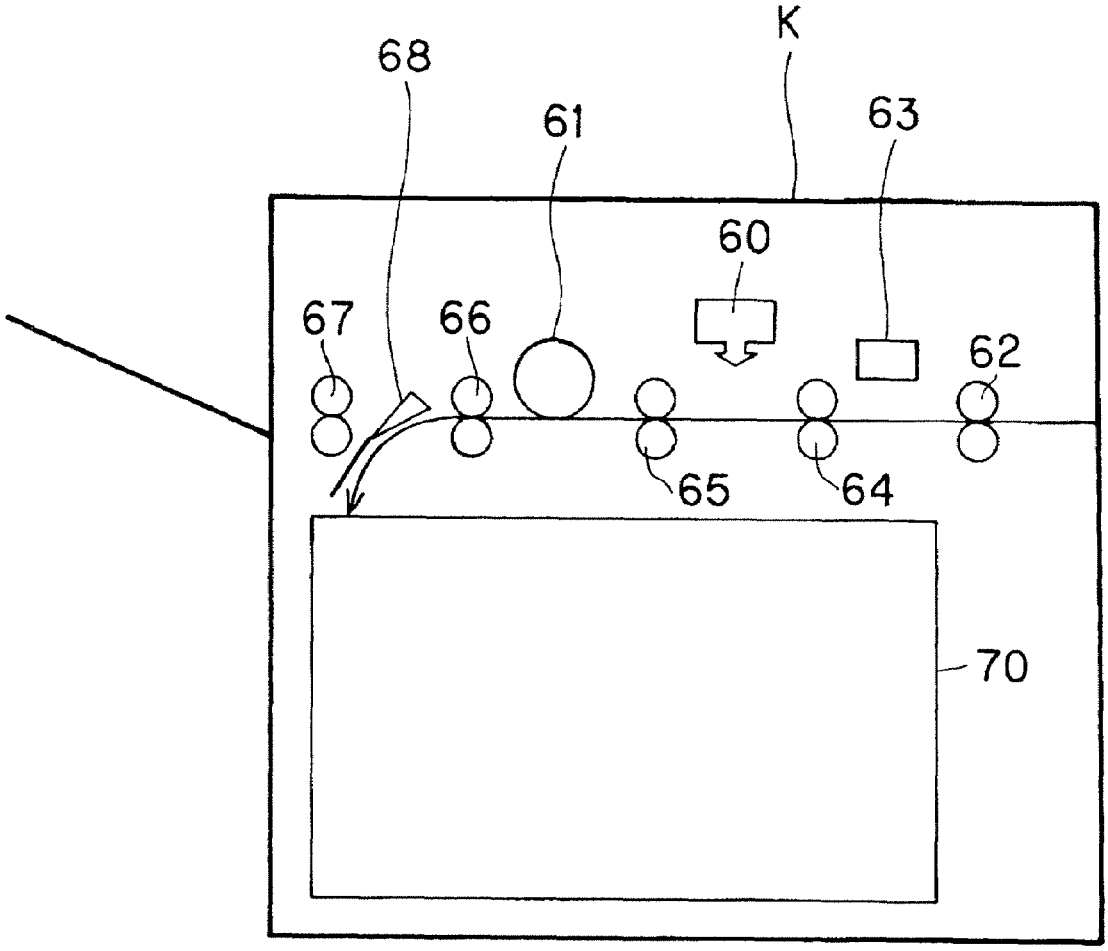
FIG. 12 is a diagram showing the arrangement of the flapper when outputting a blank sheet of paper according to the first embodiment of this invention.

When the image-formed recording material P is conveyed to the conveyance roller 66, the controller 101 controls the flappers 68 to be in the position shown in FIG. 10. As a result, the sheet is discharged outside the device as usual. On the contrary, if the blank recording material P (having no image formed thereon) is transmitted to the conveyance roller 66, the CPU 101 controls the flappers 68 to be in the position shown in FIG. 12. Then, the blank recording material falls down to the trash 70. As a result, no blank recording sheet can be discharged outside the device.

In this manner, if the CPU 101 determines that there is a blank sheet in the output materials, has on the total number of images and the number of images to be arranged on a single recording material. Upon this determination, the CPU 101 operates the flappers 68 as assorting means for assorting the image-formed output materials and blank sheets. In this embodiment, the blank portion of the recording material is set in advance as described above. The CPU 101 controls an assorting operation of the flappers 68, based on the total number of images within one job and the number of blank sheets determined based on the number of images arranged on one recording material. After assorted by the flappers 68, those image-formed output materials and blank sheets are traveled respectively outside the device and into the trash 70.

Just by way of example, the CPU 101 receives, as image formation information, information regarding the number of images to be arranged on one recording material and the total number of images, supplied from an external computer. However, the CPU 101 may receive information input from an operating unit of the image forming apparatus.

In this manner, if the position of the flappers 68 is changed in accordance with the images P3 to P6, the P3 to P6 can be led to the outside or inside of the device.

As described, a large number of high-gloss images can be output within a unit time. Further, no blank sheet is discharged outside the device, thus freeing the user from extra work to do.

Of cut pieces of the recording materials, only those image-formed recording materials are output, thus freeing the user from extra work. In addition, a large number of images can be output within a unit time. According to the first embodiment, the user is not required to do the extra work, a large number of high-gloss images can be output within a unit time. According to the first embodiment, the recording material not to he discharged outside is cut into smaller pieces than the size of the recording material output (discharged) outside the device, thus a large number of recording materials can be collected inside the device.

Second Embodiment

A cutting device and image forming apparatus according to a second embodiment of this invention will now be described. In this second embodiment, unlike the first embodiment, air blows over the recording material P, thereby switching the discharging direction of the recording material.

Figure 13:
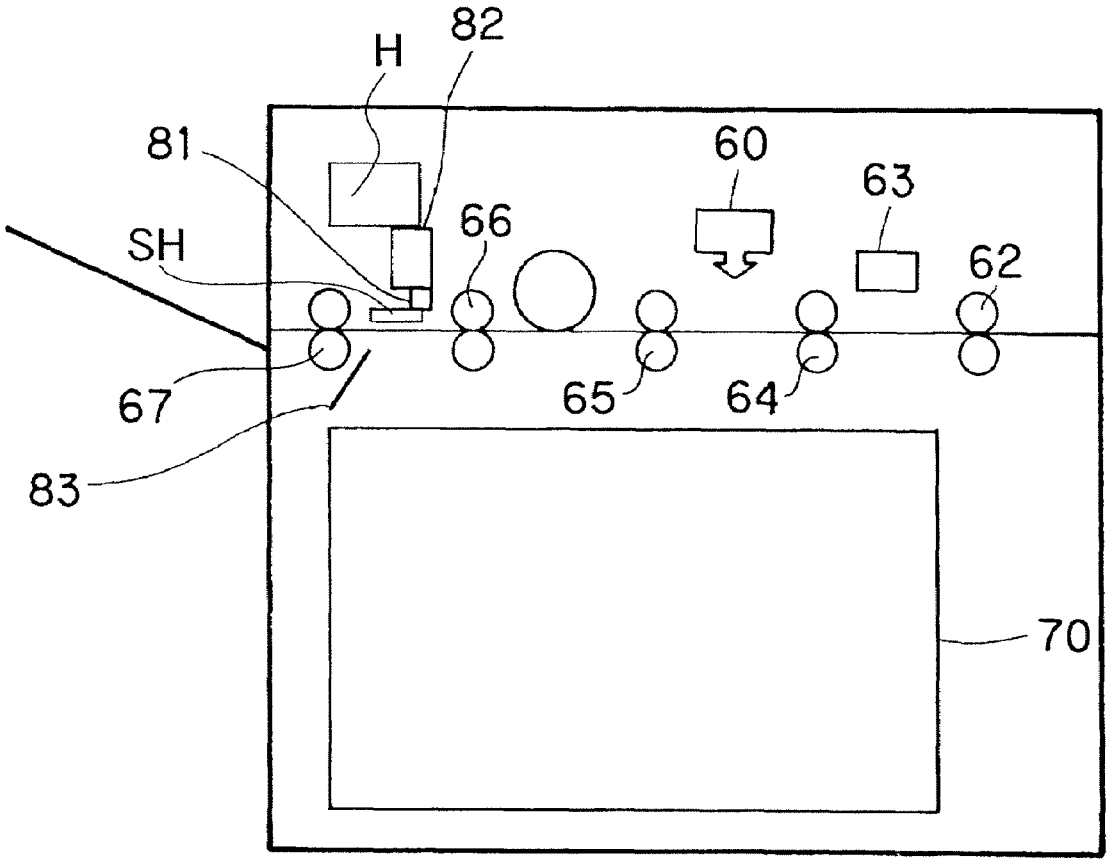
FIG. 13 is a schematic line diagram showing an air blowing device according to a second embodiment of this invention.

As shown in FIG. 13, the air blowing device is provided between the conveyance rollers 66 and 67. A fan H serves as assorting means provided on the backside of the recording material cutting device K, and sucks air. Air blows over the recording material P from a plurality of exhaust nozzles 81 through a duct 82. The plurality of exhaust nozzles 81 are arranged toward the surface of the recording material from the upper side of the material surface, between the conveyance rollers 66 and 67. Air blows from these nozzles 61 over the surface of the recording material P from its upper side.

The exhaust nozzles 81 are openable and closable by means of a shutter SH. The shutter SH opens and is closed under the control of the CPU 101 in accordance with whether an image is formed on the recording material P. That is, if an image-formed recording material is transmitted to the conveyance roller 66, the shutter SH is closed. In this case, no air blows over the recording material. At this stage, because no air pressure is given to the recording material P from the upper side, the material is conveyed to the conveyance roller 67.

On the contrary, if the recording material having no image formed thereon is conveyed to the conveyance roller 66, the shutter SH opens, and air blows over the recording material. As a result, air pressure is given to the recording material P, resulting in transmitting the material to the lower side of a conveying guide 83. Then, a selected recording material(s) freely falls downward and collected into the trash 70.

The opening/closing operation of the shutter SH is switched in accordance with whether there is an image on the recording materials P3, P4, P5 and P6 shown in FIG. 9. Accordingly, the blank recording material having no image formed thereon is collected into the trash 70 without being discharged outside the device.

As described above, according to the second embodiment, a large number of high-gloss images can be output within a unit time. When no image is formed on the recording material, it does not be discharged outside the device, thus freeing the user from extra work.

Third Embodiment

A cutting device according to a third embodiment of this invention will now be described. In this third embodiment, in the state shown in FIG. 8, the recording material P1 is divided into two pages, and no image is formed on the recording material P2. That is, in this embodiment, the recording material P is controlled to be cut, when the material has blanks that are all perpendicular to the conveying direction.

In the above-described first and second embodiments, discharging of the recording material is switched in accordance with whether an image is formed thereon, after it is cut by rotary cutter 61. If, however, large areas of the blank sheets are collected into the trash 70, the blank sheets can not easily be piled up in sequence. Thus, the trash 70 can not efficiently be useful, in terms of its capacity. In this third embodiment, therefore, the blank sheets to be collected are so cut that the trash 70 is sufficiently useful in terms of its capacity.

That is, the recording material P is cut into the recording materials P1 and P2 by the guillotine cutter 60. When the recording material P2 is a blank sheet, it will not be conveyed to the rotary cutter 61. While the guillotine cutter 60 is moved upward and downward many times, the recording material P2 is slowly conveyed and cut thereby, and then freely falls into the trash 70.

According to such a structure, the blank sheets are likely to be piled up in order, thus the trash 70 can efficiently be utilized in terms of its capacity. In order words, the user can clean the trash at long intervals, thus providing a user-friendly system.

Various embodiments of this invention have specifically been described, however, this invention is not limited to the above embodiments, and various modifications are possible based on the technical spirit of this invention. For example, the numerical values are given in the above embodiments only by way of example, and different values are possible as needed.

For example, in the first embodiment, the sheet of A4 wide size is cut into sheets of KG size. However, the sizes are not limited to the above. The same effect can still be obtained, even a recording material is cut into different sizes, as long as the material is cut at a predetermined timing corresponding to an appropriate position therefor.

For example, in the first embodiment, a fan is used as the cooling means 56. However, a contact-type cooling system may be adopted. For example, a Peltier element, a heat pipe or a water circulation cooling device may be used.

As explained above, according to any one of the above embodiments, such a recording material that does not have an image formed thereon is not output, thus freeing the user from extra work and increasing the number of output images within a unit time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-266017, filed Sep. 13, 2005, which is hereby incorporated by reference herein in its entirety.

What is claimed is:

1. An image forming apparatus comprising:

an image forming unit which forms a plurality of images on a recording material along a conveying direction of the recording material and a width direction intersecting the conveying direction;

a cutting portion which cuts an edge of the recording material, after that, which cuts the recording material along a conveying direction of the recording material and a width direction intersecting the conveying direction so that the recording material is divided according to said plurality of images; and;

a container which contains a remaining part generated from the cut recording material when the edge of the recording material is cut;

wherein when there is a blank sheet after the recording material is divided according to said plurality of images, said container contains the blank sheet.

2. An image forming apparatus according to claim 1, further comprising:

assorting means which assorts the recording material on which an image formed and the blank sheet after being cut, when it is determined that there is a blank sheet on the cut recording material based on a total number of images formed on the recording material and a number of images arranged on a single recording material, wherein said container contains said blank sheet assorted by said assorting means.

3. A cutting device according to claim 2, wherein a recording material to be contained in said container is cut into a smaller size than a size of a recording material on which an image is formed.

4. An image forming apparatus according to claim 1, wherein:

said device discharges the image-formed recording material cut by said cutting portion, to outside thereof.

5. An image forming apparatus according to claim 1, further comprising a controller which determines whether there is a blank sheet in the cut recording material based on a total number of images formed by said image forming unit and a number of images arranged on a single recording material, and operates as sorting means which assorts the cut recording material according to image-formed portion and blank portion, when it is determined that there is a blank sheet portion.

6. An image forming apparatus according to claim 1, further comprising a fixing device which pressure heats a recording material having a toner image using a fixing belt, cools down the recording material together with the fixing belt while the recording material is adhered to the fixing belt so as to solidify the toner image thereon, and allows the recording material having the toner image fixed thereon to be separated from the fixing belt.

7. An image forming apparatus according to claim 1, wherein:

said image forming apparatus can form four images on one recording material;

said cutting portion cuts the recording material along a conveying direction of the recording material and a width direction intersecting the conveying direction;

said cutting portion cuts the recording material along the conveying direction and the width direction, thereby generating four divided recording materials on which the respective four images are formed; and when a total number of images to be formed on the recording material is not a multiple of 4, a divided recording material of said four cut recording materials on which no image is formed and which is generated at a time said cutting portion cuts the recording material along the conveying direction and the width direction is contained in said container.

8. An image forming apparatus according to claim 7, wherein any of the four divided recording materials on which an image is formed is discharged to outside of said apparatus.

9. An image forming apparatus according to claim 1, wherein a recording material to be contained in said container is cut into a smaller size than a size of a recording material on which an image is formed.

10. An image forming apparatus according to claim 5, wherein said apparatus discharges only a cut portion of the recording material on which the image is formed by said image forming unit, to outside of said apparatus.

* * * * *